US005089800A

United States Patent [19]

Yang

[11] Patent Number: 5,089,800

[45] Date of Patent: Feb. 18, 1992

[54] STRUCTURE OF THERMOSTATIC SWITCH

[76] Inventor: Yu-Kang Yang, No 2-43, Lane 365, Chungshan Rd., Yung Kang Hslang,, Taiwan

[21] Appl. No.: 720,304

[22] Filed: Jun. 25, 1991

[51] Int. Cl.[5] ..... H01H 37/04; H01H 37/52

[52] U.S. Cl. ..... 337/380; 337/354; 337/372

[58] Field of Search ..... 337/380, 372, 365, 354, 337/112

[56] References Cited

U.S. PATENT DOCUMENTS 4,754,252 6/1988 Craig, III ..... 337/380

4,952,901 8/1990 Chrupcala et al. ..... 337/354

*Primary Examiner*—Harold Broome

*Attorney, Agent, or Firm*—Varndell Legal Group

[57] ABSTRACT

A thermostatic switch comprised of a casing having fastened therein a beryllium plate, which is connected to a first conductor, and a contact plate, which is connected to a second conductor, a cap attached to said casing at the top, which has a ceramic rod movably fastened therein and controlled by a bimetal element to press on said beryllium plate or release therefrom causing said beryllium plate to connect said contact plate forming into a closed circuit or disconnect therefrom forming into an opened circuit, a fastening plate secured to said cap by a top cover for fastening the thermostatic switch to a heating unit to be controlled. The beryllium plate has a raised portion engaged in a hole on the first conductor and then fastened together to the casing by a rivet. The contact plate is integrally made on the second conductor and fastened to the casing by a rivet.

2 Claims, 3 Drawing Sheets

STRUCTURE OF THERMOSTATIC SWITCH

BACKGROUND OF THE INVENTION

The present invention relates to thermostatic switches and relates more particularly to a thermostatic switch which is easy to assemble, inexpensive to manufacture and, suitable for mass production.

Thermostatic switch has been commonly used in a variety of electric home appliances, for examples: electric stoves, microwave ovens, electric air-pot, and etc., for regulating temperature. It automatically controls an electric heating unit to start or stop heating at a certain temperature. FIG. 4 illustrates a thermostatic switch according to the prior art, which comprises a casing covered with a cap for holding two conductors, two contact plates and a connecting plate, which cover has a center hole with a ceramic rod movably fastened therein and covered by a bimetal element and a top cover. The bimetal element projects upwards or inwards according to temperature change so as to control the two contact plates to form into a closed or opened circuit through the two conductors and the connecting plate. This conventional structure of thermostatic switch is not satisfactory in use because of the following disadvantages.

1. It is consisted of a number of parts which are difficult to assemble;

2. Because of complicated manufacturing procedure, the manufacturing cost is high;

3. Because of complicated manufacturing and assembling procedure, any error during processing will greatly affect the quality of the product, and therefore, permanent quality is difficult to control; and

4. The insulative casing may be damaged easily during welding process to connect the conductors to the contact plate or connecting plate.

SUMMARY OF THE INVENTION

The present invention has been accomplished to eliminate the aforesaid problems. It is therefore an object of the present invention to provide a thermostatic switch which is easy to assemble without through welding process. It is another object of the present invention to provide a thermostatic switch which is inexpensive to manufacture. It is still another object of the present invention to provide a thermostatic switch which provides high performance in temperature control.

According to the present invention, there is provided a thermostatic switch which is comprised of a casing having fastened therein a beryllium plate, a contact plate, a first conductor and a second conductor, a cap attached to said casing at the top, a ceramic rod movably fastened in said cap and controlled by a bimetal element to press on said beryllium plate or release therefrom causing said beryllium plate to connect said contact plate forming into a closed circuit or disconnect therefrom forming into an opened circuit, a fastening plate secured to said cap by a top cover for fastening the thermostatic switch to a heating unit to be controlled. The beryllium plate has a raised portion engaged in a hole on the first conductor and then fastened together to the casing by a rivet. The contact plate is integrally made on the second conductor and fastened to the casing by a rivet.

DETAILED DESCRIPTION OF THE PREFERRED EMBODIMENT

Figure 1:
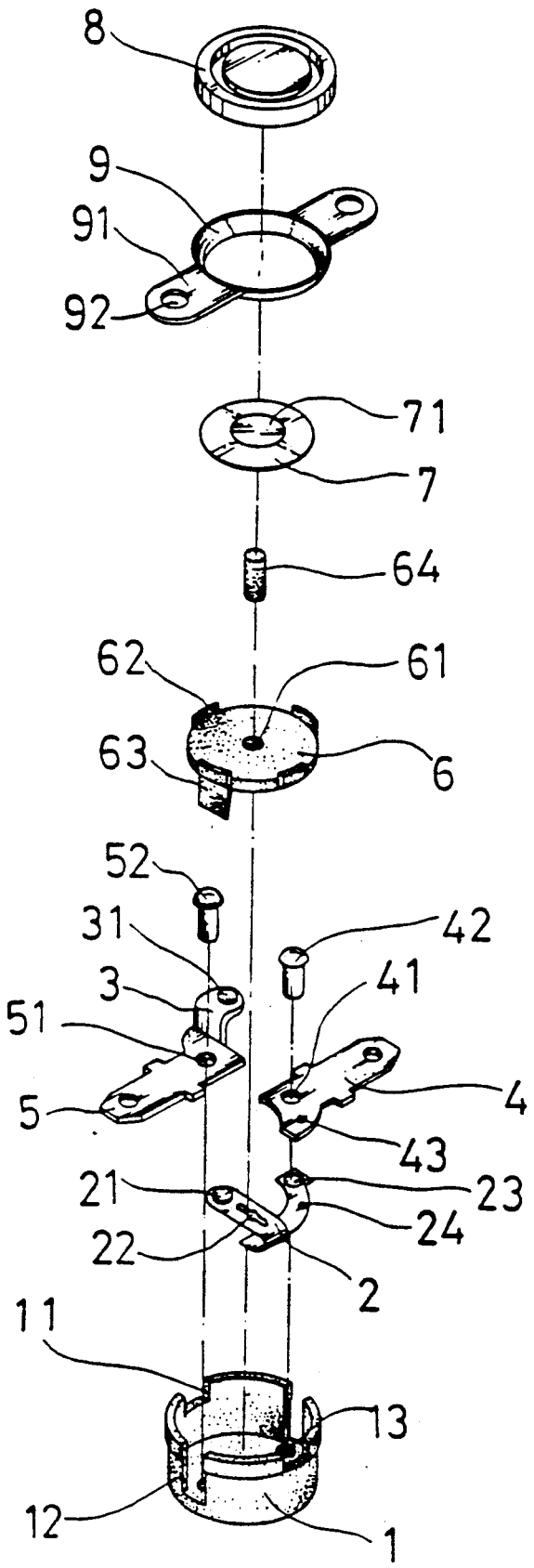
FIG. 1 is an exploded perspective view of the preferred embodiment of the thermostatic switch of the present invention.
Figure 2:
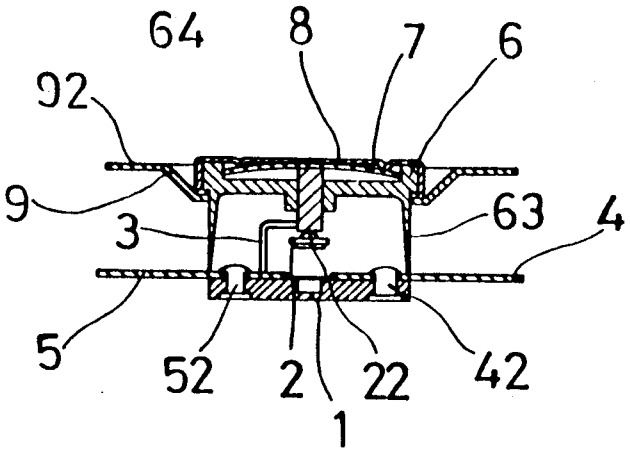
FIG. 2 is a sectional assembly view thereof, showing that the circular, curved surface projects upwards permitting the contact point on the beryllium plate to connect the contact point on the contact plate.
Figure 4:
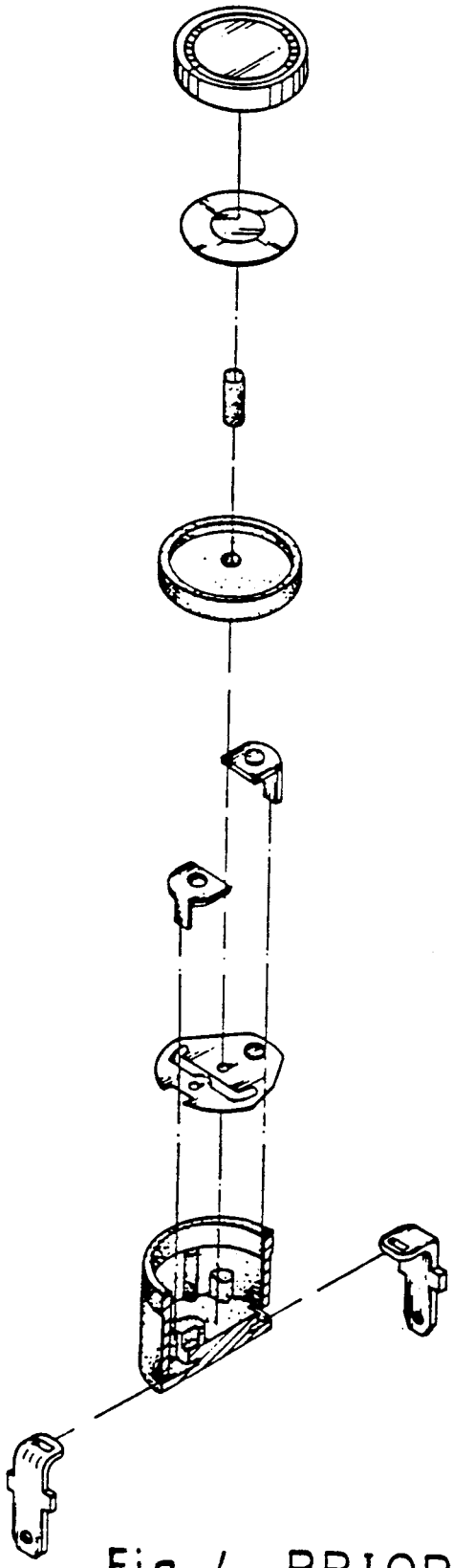
Fig. 4 PRIOR ART
FIG. 4 is an exploded perspective view of the prior art.

Referring to FIGS. 1 and 2, a thermostatic switch in accordance with the present invention is generally comprised of a casing 1, a beryllium plate 2, a contact plate 3, a first conductor 4, a second conductor 5, a cap 6, a bimetal element 7, a top cover 8 and a fastening plate 9.

The casing 1 has two small notches 11 on the top edge thereof at two opposite locations and two elongated notches 12 on the periphery thereof at two opposite locations respectively provided for fastening the cap 6, and two round holes 13 on the bottom thereof at two opposite locations provided for fastening the two conductors 4 and 5 and the beryllium plate 2.

The beryllium plate 2 has a contact point 21 and a bearing point 22 at one end and two spaced round holes 23 and 24 at an opposite end.

The contact plate 3 is integrally formed on the second conductor 5, having a contact point 31 disposed in contact with the contact point 21 on the beryllium plate 2 forming into a closed circuit.

The first conductor 4 has a round hole 41 at one end and a raised portion 43 on the bottom edge thereof. During assembly, a rivet 42 is fastened through the round hole 41 on the first conductor 4, one round hole 23 on the beryllium plate 2 into on round hole 13 on the casing 1 to fixedly secure the first conductor 4 and the beryllium plate 2 to the casing 1. When the first conductor 4 and the beryllium plate 2 are secured to the casing 1, the raised portion 43 on the first conductor is engaged in the other round hole 24 on the beryllium plate 2. The second conductor 5 has a round hole 51 adjacent to the contact plate 3 (which is incorporated into the second conductor 5 at one end) which is fastened to the other round hole 13 on the casing 1 by a rivet 52.

The cap 6 has two opposite, small strips 62 and two opposite, elongated strips 63 raised from the periphery thereof and respectively disposed at locations corresponding to the two small notches 11 and the two elongated slots 12 on the casing 1 for fastening, and a round hole 61 at the center with a ceramic rod 64 inserted therein. By fastening the small and elongated strips 62 and 63 into the small notches 11 and the elongatd slots 12, the cap 6 is firmly secured to the casing 1 at the top with the ceramic rod 64 stopped at the bearing point 22 on the beryllium plate 2. Therefore, pressing the ceramic rod 64 causes the contact point 21 on the beryllium plate 2 to disconnect from the contact point 31 on the contact plate 3.

The bimetal element 7 has a circular, curved surface portion 71 at the center which projects upwards permitting the contact point 21 on the beryllium plate 2 to contact the contact point 31 on the second conductor 5 when temperature is below a fixed range, or projects downwards to force the ceramic rod 64 to press down the bearing point 22 on the beryllium plate 2 causing the contact point 21 on the beryllium plate 2 to disconnect from the contact point 31 on the contact plate 3.

The fastening plate 9 has two lugs 91 extending outwards into two opposite directions, which lugs 91 have each a hole 92 thereon for fastening to a heating unit to be controlled.

To assemble the aforesaid parts into a thermostatic switch is easy and outlined hereinafter. The first conductor 4 is secured to the beryllium plate 2 by fastening the raised portion 43 into the round hole 24, then, use the rivets 42 and 52 to respectively secure the first conductor, the beryllium plate 2 and the second conductor 5 to the two round holes 13 on the casing 1 permitting the first and second conductors 4 and 5 to respectively extend out of the two elongated slots 12. After the ceramic rod 64 has been fastened in the round hole 61 on the cap 6, the cap 6 is attached to the casing 1 by fastening the small and elongated strips 62 and 63 in the small notches 11 and the elongated slots 12. As soon as the bimetal element 7 is placed on the cap 6 at the top, the fastening plate 9 is mounted on the casing 1 at the top and then, the top cover 8 is attached to the fastening plate 9 to firmly secure the bimetal element 7 to the cap 6.

Figure 3:
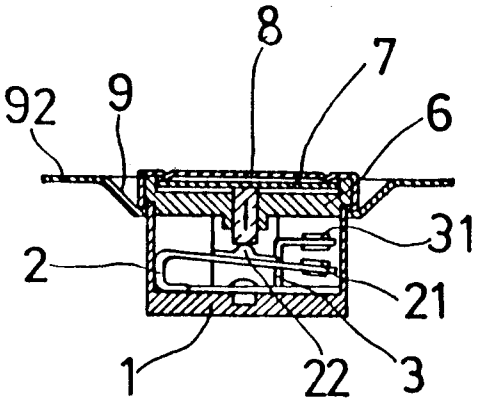
FIG. 3 is a sectional view showing the circular, curved surface projects downwards causing the contact point on the beryllium plate to disconnect from the contact point on the contact plate.

Referring to FIG. 3, when temperature reaches a fixed range, the circular, curved surface portion 71 is automatically caused to project downwards forcing the ceramic rod 64 to press on the bearing point 22 and therefore, the contact point 21 on the beryllium plate 2 is disconnected from the contact point 31 on the contact plate 3, forming into a broken circuit. Thus, the controlled heating unit immediately stops heating. On the other hand, the circular, curved surface portion 71 is automatically caused to project upwards, when temperature is below a fixed range, permitting the contact point 21 on the beryllium plate 2 to contact the contact point 31 on the contact plate 3 again, so as to form into a closed circuit, and therefore, the controlled heating unit is electrically connected to produce heat.

I claim:

1. A thermostatic switch comprised of a casing having fastened therein a beryllium plate, a contact plate, a first conductor and a second conductor, a cap attached to said casing at the top, a ceramic rod movably fastened in said cap and controlled by a bimetal element to press on said beryllium plate or release therefrom causing said beryllium plate to connect said contact plate forming into a closed circuit or disconnect therefrom forming into an opened circuit, a fastening plate secured to said cap by a top cover for fastening the thermostatic switch to a heating unit to be controlled, and characterized in that:

said casing has two small notches on the top edge thereof at two opposite locations, two elongated notches on the periphery thereof at two opposite locations and two round holes on the bottom edge thereof;

said beryllium plate has a contact point and a bearing point at one end, and two spaced round holes at an opposite end;

said first conductor has a round hole at one end aligned with one round hole on said beryllium plate for fastening in one round hole on said casing by a rivet, and a raised portion on the bottom edge thereof engaged in the other round hole on said beryllium plate;

said second conductor has a round hole at one end secured to the other round hole on said casing by a rivet;

said contact plate has one end integrally incorporated into said second conductor at one end and a contact point at an opposite end disposed in contact with the contact point on said beryllium plate;

said cap has two opposite, small strips and two opposite, elongated strips raised from the periphery thereof and respectively fastened in said two small notches and said two elongated slots on said casing, and a round hole at the center to hold said ceramic rod therein permitting it to be forced by said bimetal element to press on said bearing point causing the contact point on said beryllium plate to disconnect from the contact point on said contact plate.

2. The thermostatic switch according to claim 1, wherein said contact plate is separately made and connected to said second conductor either through a rivet or pivot joint.

* * * * *

UNITED STATES PATENT AND TRADEMARK OFFICE

CERTIFICATE OF CORRECTION

PATENT NO. : 5,089,800

DATED : February 18, 1992

INVENTOR(S) : Yu-Kang Yang

It is certified that error appears in the above-identified patent and that said Letters Patent is hereby corrected as shown below:

On the title page, item (76):

In the inventor's address, change "Hslang,, Taiwan" to

--Hsiang, Tainan Hsien, Taiwan, R.O.C.--

Signed and Sealed this

Fourth Day of May, 1993

*Attest:*

Michael K. Kirk

MICHAEL K. KIRK

*Attesting Officer*

*Acting Commissioner of Patents and Trademarks*